United States Patent [19]

Vroomen

[11] Patent Number: 4,532,683

[45] Date of Patent: Aug. 6, 1985

[54] DEVICE FOR CUTTING SEAMS FREE IN A CORDUROY CUTTING MACHINE AND METHOD FOR OPERATING THE SAME

[75] Inventor: Albert Vroomen, Monchen-Gladbach, Fed. Rep. of Germany

[73] Assignee: Franz Müller GmbH & Co., Monchen-Gladbach, Fed. Rep. of Germany

[21] Appl. No.: 600,604

[22] Filed: Apr. 17, 1984

Related U.S. Application Data

[63] Continuation of Ser. No. 299,520, Sep. 4, 1981, abandoned.

[30] Foreign Application Priority Data

Sep. 9, 1980 [DE] Fed. Rep. of Germany ..... 3033792

[51] Int. Cl.[3] ..... D06C 13/08

[52] U.S. Cl. ..... 26/10 C

[58] Field of Search ..... 26/8 C, 9, 10 C

[56] References Cited

U.S. PATENT DOCUMENTS

| | | | |
|---|---|---|---|
| 2,895,209 | 7/1959 | Sanders | 26/10 C |
| 3,044,141 | 7/1962 | Gaskins | 26/10 C |
| 4,142,277 | 3/1979 | Gierse | 26/9 |

FOREIGN PATENT DOCUMENTS

| | | | |
|---|---|---|---|
| 127007 | 1/1902 | Fed. Rep. of Germany | 26/9 |
| 2740402 | 3/1979 | Fed. Rep. of Germany . | |
| 352 | of 1852 | United Kingdom | 26/9 |
| 3836 | of 1875 | United Kingdom | 26/9 |
| 1118 | of 1876 | United Kingdom | 26/9 |

*Primary Examiner*—Robert R. Mackey

*Attorney, Agent, or Firm*—Herbert L. Lerner; Laurence A. Greenberg

[57] ABSTRACT

Corduroy cutting machine, including a shaft, a multiplicity of circular knives laterally aligned on the shaft, a cutting edge associated with the knives, a plurality of needles having points and longitudinal slots formed therein and being insertible against a given travel direction of a web of material into floating wefts of the material to be cut open, each of the needles being immersible into one of the slots, a contact table disposed beneath the points of the needles, a switch for stopping the machine being actuatable by contact between the contact table and needles, a working surface being disposed upstream of the contact table in travel direction of the web of material on which the web of material can be fed from below, a feed cylinder disposed upstream of the working surface in travel direction of the web of material around which the web of material to be cut can be looped from below and fed past the contact table to the cutting edge, the working surface being defined by the needles, contact table and feed cylinder, and the contact table being lowerable below the working surface.

7 Claims, 4 Drawing Figures

DEVICE FOR CUTTING SEAMS FREE IN A CORDUROY CUTTING MACHINE AND METHOD FOR OPERATING THE SAME

This application is a continuation of application Ser. No. 299,520, filed Sept. 4, 1981, now abandoned.

The invention relates to a corduroy cutting machine with a multiplicity of circular knives which are aligned side by side on a shaft, the knives are associated with a cutting edge and are each immersed into the longitudinal slot of a needle which can be inserted against the travel direction of the material into the floating wefts to be cut open, a contact table which is disposed underneath the points of the needles and which, upon contact with a needle, actuates a switch for stopping the machine, the web of material being feedable directly or indirectly from below, and particularly from a working plane which precedes the contact table in the travel direction of the material and is defined by the needles and the contact table and by the feed or traction cylinder around which the web of material to be cut can be looped from below into the working plane, as well as past the contact table to the cutting edge.

Corduroy cutting machines of this type are known, for instance, from German Pat. No. DE-PS 27 40 402. Such machines serve for processing of weft velvet, or more accurately, rib velvet. In weft velvet, the nap is provided by a special weft, the righthand floats of which are cut open on the corduroy cutting machine. The latter operation is accomplished by drawing the material, which is tensioned in the warp direction, over the cutting edge cooperating with the knife shaft. The floating wefts form tubes and every tube runs up on one of the needles. Every needle has a longitudinal slot, into which one of the circular knives mounted on the knife shaft is immersed. By adjusting the knife shaft, which can be swung perpendicularly to its longitudinal direction, the distance between the periphery of the circular knives and the cutting edge of the machine can be set in such a way that the floating weft threads of the passing fabric are cut, but the base fabric remains untouched.

In normal operation of the machine, it is preferable to guide the needles, preferably with intermittent feed, in such a manner that the needle points neither leave the respective tube downwardly through the base fabric nor upwardly from the tube. In case of such needle egress, separate contact bars are disposed above and below the needles in such a manner that the egress of a needle results in a signal for immediately stopping the machine. While the result of a needle egress upward is that the fabric tube in question is not cut, egress of the needle downward may mean a cut into the base fabric, which contrary to the former type of egress that can be reworked, produces a defect which cannot be repaired. In all corduroy cutting machines, special attention is therefore given to the contact table which is located underneath the plane defined by the needles in operation, with the objective of assuring contact which is as reliable and fast as possible in the event of a needle egress downward.

In the operation of a corduroy cutting machine, sections sewed together to a length of 100 to 120 m are often cut in sequence. With material velocities of, for instance, only 10 m/min, the net cutting time per section is therefore about 10 to 12 min. In addition thereto, this requires a resetting of the needles, such as five needles per cm of material width, from the completely cut section to the next section over the seam in question. This resetting of needles takes at least about 15 min in present-day machines, depending on the dexterity of the operator. In resetting, the needles must first be pulled out of the finished piece. This needle pulling takes about 5 min, which therefore corresponds to about $\frac{1}{3}$ of the resetting time.

It is accordingly an object of the invention to provide a corduroy cutting machine and method of operating the same, which overcomes the hereinafore-mentioned shortcomings of the heretofore-known devices and methods of this general type, and to reduce the time for resetting the needles and in particular, the needle pulling time.

With the foregoing and other objects in view, there is provided, in accordance with the invention, the corduroy cutting machine mentioned above with a contact table disposed underneath the working plane defined by the needles, comprising a shaft, a multiplicity of circular knives laterally aligned on the shaft, a cutting edge associated with the knives, a plurality of needles having points and longitudinal slots formed therein and being insertible against a given travel direction of a web of material into floating wefts of the material to be cut open, each of the needles being immersible into one of the slots, a contact table disposed beneath the points of the needles, a switch for stopping the machine being actuatable by contact between the contact table and needles, a working plane or surface being disposed upstream of the contact table in travel direction of the web of material on which the web of material can be fed directly or indirectly from below, a feed cylinder disposed upstream of the working surface in travel direction of the web of material around which the web of material to be cut can be looped from below and fed past the contact table to the cutting edge, the working surface being defined by the needles, contact table and feed cylinder, and the contact table being lowerable below the working surface.

Through the use of the invention, the web of material fed under tension over the contact table to the cutting edge can be pulled down at will, together with the contact table, in such a manner that all needles egress upward and thereby, all needles can be cut free, so to speak, simultaneously with the movement of the web of material. Thus, pulling out the needles in the proper sense is no longer necessary with the mode of operation according to the invention, since the needles are automatically cut out of the respective fabric tube by the circular knife when the web of material advances. This is accomplished because the plane of the web of material is lowered downward from the plane of the needles or is bent off, without making contact with the contact strip registering egress of the needles upward, or if this contact strip is put out of operation.

The contact table which can be lowered or swung down at will, according to the invention, can be made to be exactly as long in the travel direction of the material as was customary heretofore. It is therefore ensured that in the event that a needle egresses downward, the machine can be reliably and quickly switched off even if different needle lengths are used, so that the egress point of the needle comes to a stop before it runs onto the cutting edge.

In the machine according to the invention, the web of material can be fed to the contact table either directly past a compensation or equalizer cylinder, or past an interposed so-called "rear" table to the needles. In either case, it should be possible to lower at least that portion of the contact table which is under the needle points, from the working plane defined by the needles, such as about a pivot axis extending parallel to the cutting edge. Preferably, the distance from the pivot axis of the contact table to the cutting edge is kept smaller than the shortest needle. Alternatively, however, the contact table can also be flexible, especially in the form of an elastic leaf spring. The purpose of the compensating or equalizing roller following the feed cylinder is to equalize the change in the length of the material in the run between the feed cylinder and the cutting edge when the contact table and the rear table if applicable, is swung. This is done in such a manner that the tension of the material remains substantially unchanged. Normally, the equalizing cylinder can work against an upper stop.

If the web of material is not to be fed directly by a feed cylinder to the contact table, but rather to the contact table first past the rear table which is to be held in the working plane in normal operation, the rear table can be lowered downward from the working plane at will, especially ahead of a seam, for cutting the needles free. Preferably, the rear table is to be pivoted in such an embodiment about an axis between the feed cylinder around which the web of material to be cut is to be looped below the working plane and the contact table, at a distance from the point of the longest needle. Advantageously, the lowering of the rear table is coupled with that of the contact table for simultaneous execution of the two movements, unless the contact table is already so flexible that it is automatically bent downward when the rear table is lowered.

In view of the foregoing, in accordance with another feature of the invention, there is provided a pivot axis disposed parallel to the cutting edge, at least a portion of the contact table beneath the points of the needles being lowerable from the working surface about the pivot axis.

In accordance with a further feature of the invention, the pivot axis is spaced at distance from the cutting edge which is smaller than the length of the shortest of the needles.

In accordance with an added feature of the invention, the contact table is flexible and is especially a leaf spring.

In accordance with an additional feature of the invention, there is provided a rear table disposed at a distance from the contact table upstream of the points of the needles in travel direction of the web of material, the rear table being operable to be held in the working surface during cutting operation and being selectively lowerable simultaneously from the working surface with the contact table especially ahead of a seam for cutting the needles free.

In accordance with yet another feature of the invention, there is provided a pivot axis for the rear table being disposed between the feed cylinder and the contact table at a distance from the point of the longest of the needles.

In accordance with yet a further feature of the invention, there is provided an equalizing cylinder being disposed between the rear table and the feed cylinder, and a stop, the equalizing cylinder being operable to press with the force of its weight onto the web of material and being movable against the stop especially upward.

In accordance with a concomitant mode of the invention, there is provided a method which comprises bending the web of material in the vicinity of the needles by lowering the rear table and the contact table, and forcing egress of all of the needles upwardly for automatically cutting the needles free.

The construction and method of operation of the invention, however, together with additional objects and advantages thereof will be best understood from the following description of specified embodiments when read in connection with the accompanying drawings, in which.

Figure 1:
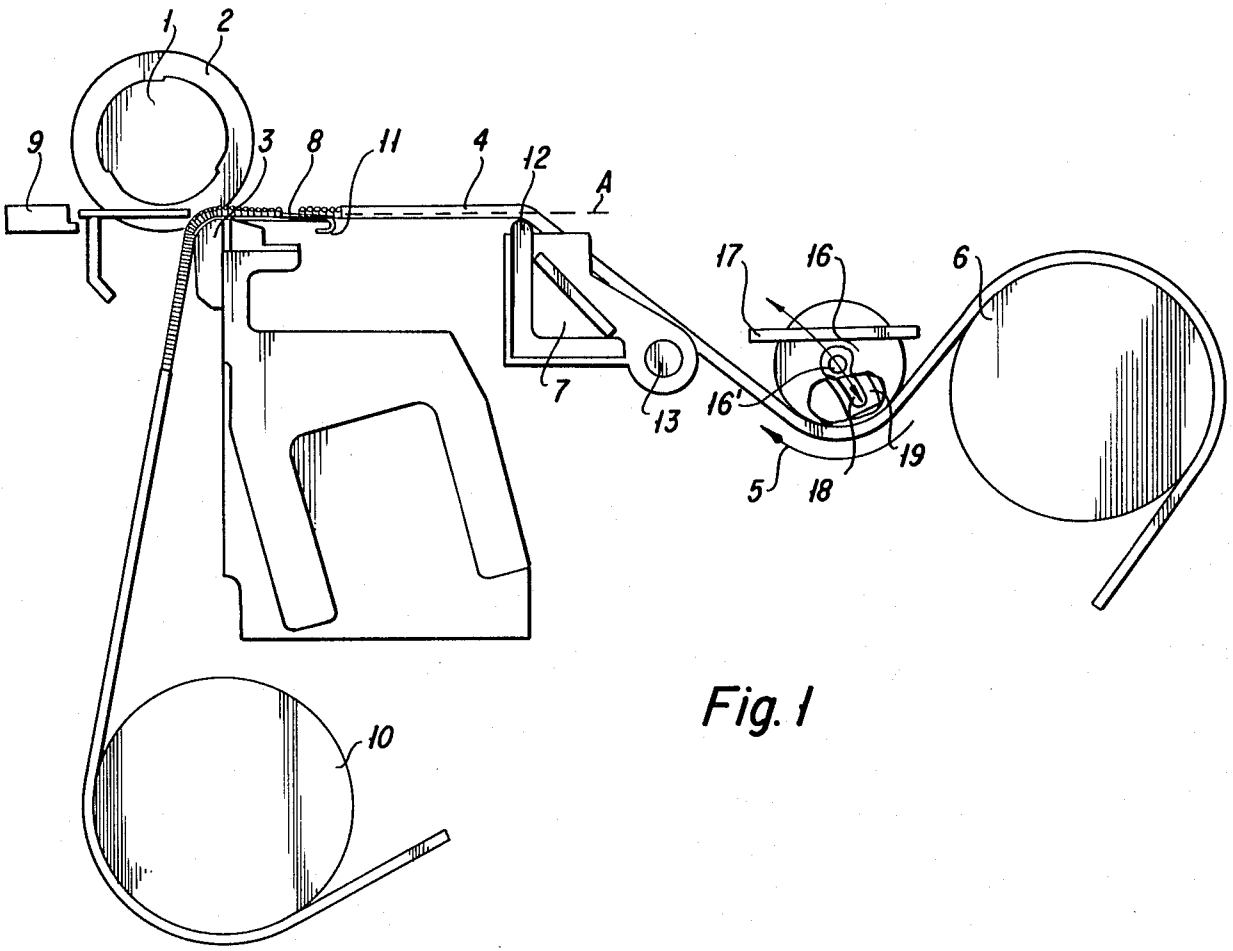
FIG. 1 is a diagrammatic cross-sectional view through a corduroy cutting machine perpendicular to the axis of the cutting knife shaft, with the web of material in place for normal cutting operation.
Figure 2:
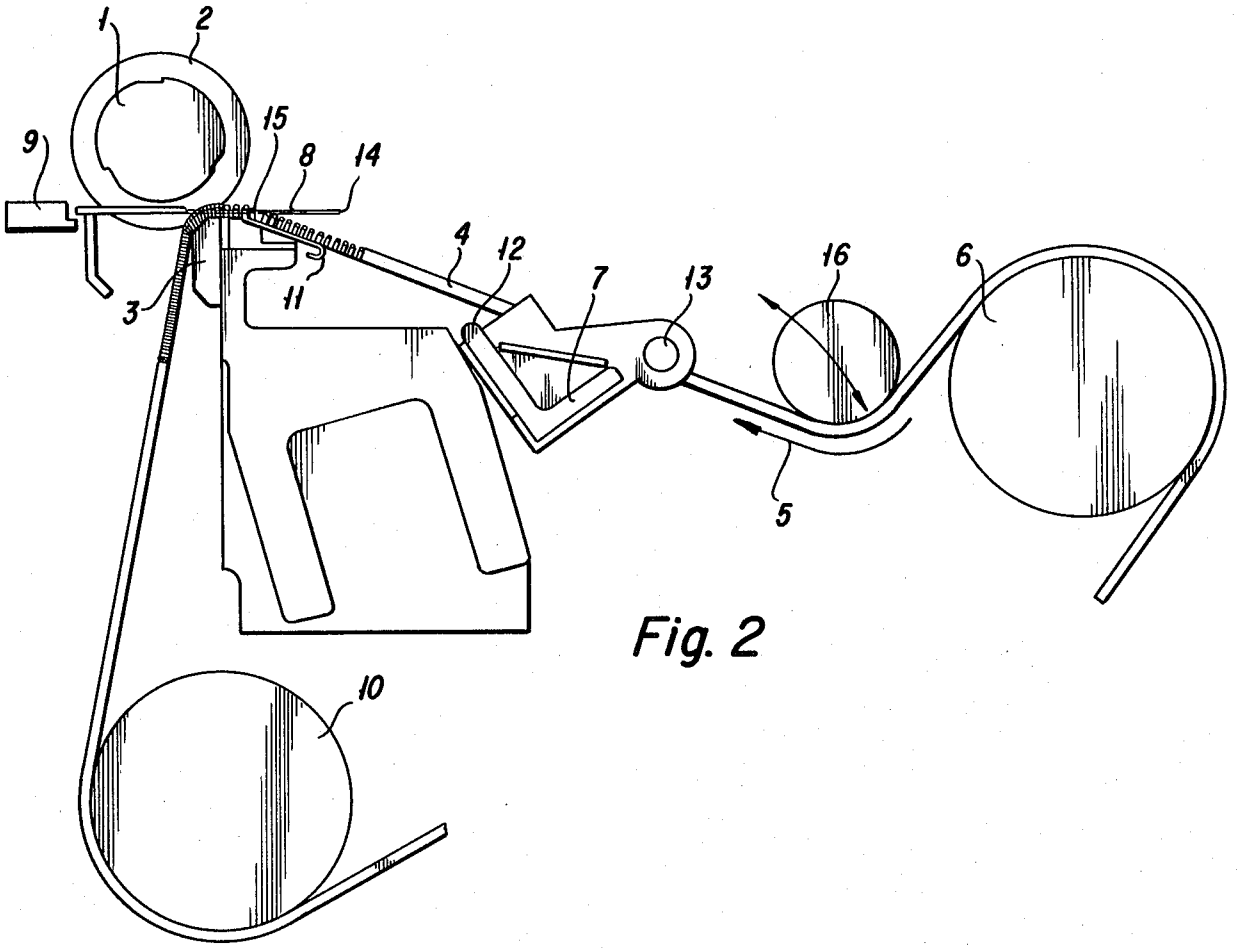
FIG. 2 is a cross-sectional view through the machine according to FIG. 1 with the web of material deflected downwardly in accordance with the invention.

Referring now to FIGS. 1 and 2 of the drawings as a whole, it is seen that the corduroy cutting machine shown therein includes a multiplicity of circular knives 2 which are aligned side by side on a cutting knife shaft 1 and are associated with a cutting edge 3. A web of material 4 runs in the direction of the arrow 5 over a feed cylinder 6 and a so-called rear table 7 onto needles 8 that are disposed at the cutting edge 3, in such a manner that a needle 8 is introduced into each of the weft tubes of the web of material to be cut open. Through a longitudinal slot provided in each needle, the circular knife 2 associated with the respective needle penetrates in such a manner that it approaches the cutting edge 3 up to a predetermined distance, which is determined in particular by the thickness of the base fabric of the web of material 4. The needles 8 are as a rule driven by plungers 9 from the back in such manner that they advance in the respective weft tube of the web of material 4 by a jerking motion. The longitudinal tension or the tension in the warp direction of the web of material required for proper cutting is ensured by a drawing-off cylinder 10, and the feed cylinder 6. An equalizing cylinder 16 disposed between the feed cylinder 6 and the rear table 7, presses with its weight against the web 4 and is movable upward against a stop 17 which is struck by a bushing 16' of the cylinder 16. The bushing 16' is movable up and down as indicated by the arrow in a slot 18 formed in a bearing block 19.

For registering needle egresses downwardly and for conducting the web of material 4 in the region of the needles 8, the corduroy cutting machine has a so-called contact table 11. The table 11 ensures that even if different needle lengths are used, the machine is switched off by a signal passed on from the contact table 11 in such reliable and quick a manner that the point of egress of the respective needle 8 comes to a stop before it runs up onto the cutting edge 3. Obviously, the contact table 11 must then have a certain length in the travel direction of the web of material (the direction of the arrow 5) which depends on the machine speed and the braking capacity. For registering and signalling needle egress upwardly, contact bars or the like, not shown in the present case, are provided in corduroy cutting machines above the web of material 4.

During normal operation of the machine according to FIG. 1, the rear table 7 with the relevant rear table edge 12 (in the so-called working plane A) is at the same height as the cutting edge 3. At the same time, the contact table 11 associated with the needles 8 as the lower contact bar or guide, is so close to the web of material 4, that upon needle egress downwardly, all customary needle lengths cause the machine to stop immediately.

In the embodiment example, it is further assumed that the contact table 11 is constructed as a flexible leaf spring. Alternatively, the contact table 11 may also be pivoted about a pivot axis which can be disposed relatively close to the cutting edge 3. According to the invention, the rear table 7 is preferably swung downwardly about a pivot axis 13 for the purpose of releasing the needles 8 from the web of material 4. This is preferably performed immediately before a seam for resetting the needles to the next web of material, according to FIG. 2. It is carried out in such a manner that the web of material 4 is deflected downward from the working plane A defined by the needles 8 and the needles all simultaneously leave the respective weft tubes upwardly. In principle, this is done without moving away from their plane. The free needle points are designated with reference numeral 14 in FIG. 2. By swinging down the rear table 7 and because of the bending of the web of material 4 at the needle points 14, the contact table 11, especially if it is constructed in the form of a leaf spring, is gradually lowered to the extent that the bending point 15 of the web material travels from the needle point 14 to the cutting edge 3. The egress of the needles 8, or of their points 14 from the top of the web of material 4 takes place by a jerking motion at the next respective advance of the plunger 9. As soon as the piercing point has advanced to the cutting edge 3, the needle 8 lies on top of the material.

Figure 3:
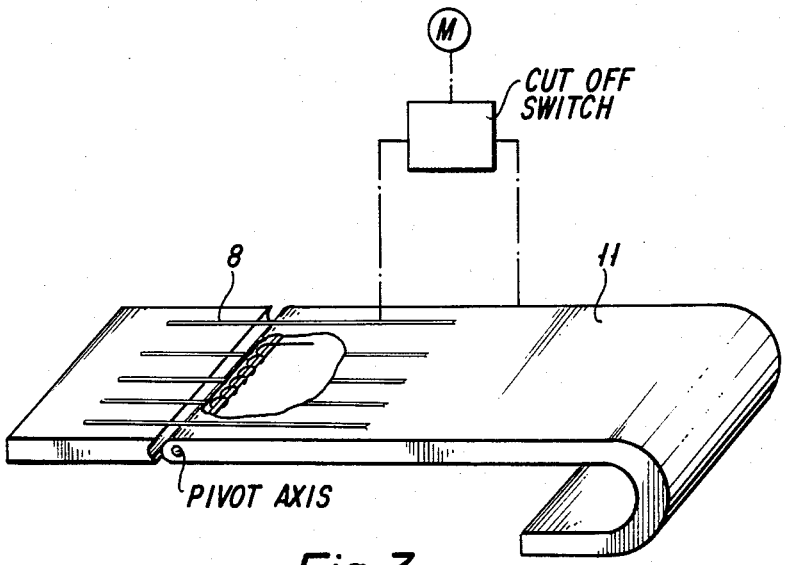
FIG. 3 is a perspective view, partly broken away, showing the contact table with a pivot axis on on enlarged scale.

As seen in FIG. 3, the right-hand portion of the contact table 11 is supported by a spring 11′ which maintains this portion of the table in the horizontal position shown, level with the left-hand portion of the table, as long as the rear table 7 is in the upright position shown in FIG. 1. When the rear table 7 is lowered manually by an operator, such as because a seam is approaching, the tension of the web of material pulls down the right-hand portion of the contact table 11, as shown in FIG. 2.

Figure 3A:
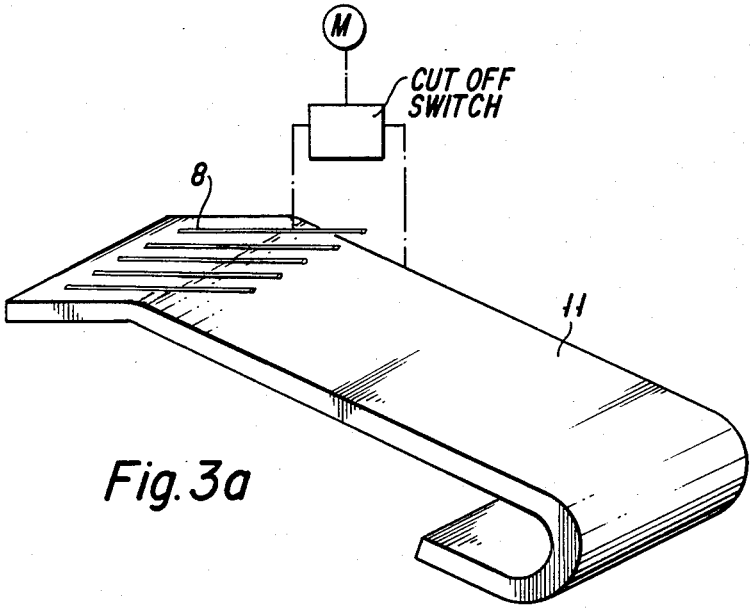
FIG. 3*a* is a view similar to FIG. 3 of a flexible contact table on an enlarged scale.

Whereas the right-hand portion of the contact table of FIG. 3 pivots about the pivot axis as shown, the table of FIG. 3*a* is flexible, resulting in an equivalent lowering.

In both FIGS. 3 and 3*a*, a cut off switch is connected to the needles, the contact table and a motor driving the machine. Upon contact between the needles and the contact table, the switch stops the motor.

When a seam is approaching and the tables are lowered with the web 4, the uncut loops of the web which have not yet reached the points 14 of the needles merely fall below the needles. The uncut loops which are already entrained on the needles slide along the needles and are cut by the knives 2.

Regardless of the manner in which the above-described bend 15 is placed into the web of material 4, the needles are released from the corresponding weft loops in any case with the machine running. Customarily, the machine is switched off upon the approach of a seam, such as in several steps, so that the operator can start pulling out and resetting the needles subsequently without appreciable forward or backward motion of the web. With the construction according to the invention, the automatic preparation of the machine can be perfected, so that the automation also includes the release and cutting-free of the needles. Through the construction and operation according to the invention, the working time for pulling the needles (about 5 minutes), which is about $\frac{1}{3}$ of the resetting time of the above-mentioned 15 minutes, is saved in practice.

Although the invention is illustrated and described herein as embodied in a corduroy cutting machine and method of operating the same, it is nevertheless not intended to be limited to the details shown, since various modifications and structural changes may be made therein without departing from the spirit of the invention an within the scope and range of equivalents of the claims.

I claim:

1. Corduroy cutting machine, comprising a shaft, a multiplicity of circular knives laterally aligned on said shaft, a cutting edge associated with said knives, a plurality of needles having points and longitudinal slots formed therein and being insertible against a given travel direction of a web of material into floating wefts of the material to be cut open, each of said knives being immersible into one of said slots, a contact table disposed beneath the points of said needles, means for tensioning the web of material, a motor for driving the tensioning means, a switch connected to said needles and to said contact table for stopping the motor driving the tensioning means by accidental contact between said contact table and needles, a working plane being disposed upstream of said contact table in travel direction of the web of material on which the web of material can be fed from below, a feed cylinder disposed upstream of said working plane in travel direction of the web of material around which the web of material to be cut can be looped from below and fed past said contact table to said cutting edge, a rear table disposed between said feed cylinder and said contact table upstream of said points of said needles for supporting the web of material, means for lowering said rear table for cutting the needles free, said working plane being defined by said needles, contact table, rear table and feed cylinder, and means for lowering said contact table below said working plane by the tension on the web of material when said rear table is lowered.

2. Corduroy cutting machine according to claim 1, including a pivot axis disposed parallel to said cutting edge, at least a portion of said contact table being disposed beneath the points of said needles and being lowerable from said working plane about said pivot axis.

3. Corduroy cutting machine according to claim 2, wherein said pivot axis is spaced at a distance from said cutting edge which is smaller than the length of the shortest of said needles.

4. Corduroy cutting machine according to claim 1, wherein said contact table is flexible.

5. Corduroy cutting machine according to claim 1, including a pivot axis for said rear table being disposed between said feed cylinder and said contact table at a distance from the point of the longest of said needles.

6. Corduroy cutting machine according to claim 5, including an equalizing cylinder being disposed between said rear table and said feed cylinder, a stop, and means for permitting said equalizing cylinder to press with the force of its weight onto the web of material and against said stop.

7. Method of operating a corduroy cutting machine, including a shaft, a multiplicity of circular knives laterally aligned on the shaft, a cutting edge associated with the knives, a plurality of needles having points and longitudinal slots formed therein and being insertible against a given travel direction of a web of material into floating wefts of the material to be cut open, each of the knives being immersible into one of the slots, a contact table disposed beneath the points of the needles, means for tensioning the web of material, a motor for driving the tensioning means, a switch connected to the needles and to the contact table for stopping the motor driving the tensioning means by accidental contact between the contact table and needles, a working plane being disposed upstream of the contact table in travel direction of the web of material on which the web of material can be fed from below, a feed cylinder disposed upstream of the working plane in travel direction of the web of material around which the web of material to be cut can be looped from below and fed past the contact table to the cutting edge, the working plane being defined by the needles, contact table and feed cylinder, a rear table disposed at a distance from the contact table upstream of the points of the needles in travel direction of the web of material, the rear table being held in the working plane during cutting operation, means for lowering the rear table from the working plane, and means for lowering the contact table below the working plane by the tension applied to the web of material when the rear table is lowered for cutting the needles free, which comprises bending the web of material in the vicinity of the needles by lowering the rear table and the contact table, and forcing egress of all of the needles upward for automatically cutting the needles free.

* * * * *